United States Patent [19]

Wightman et al.

[11] 4,235,090

[45] Nov. 25, 1980

[54] DENT PULLING TOOL

[76] Inventors: Stacy R. Wightman, Rang Pelletier Sud, St. Armand, Quebec, Canada, J0J1T0; Lawrence W. Wightman, Stanbridge East, Quebec, Canada, J0J2H0

[21] Appl. No.: 937,866

[22] Filed: Aug. 29, 1978

[51] Int. Cl.[3] ..... B21D 1/12

[52] U.S. Cl. ..... 72/479; 72/705

[58] Field of Search ..... 72/705, 479; 254/131; 294/97

[56] References Cited

U.S. PATENT DOCUMENTS

| | | | |
|---|---|---|---|
| 1,890,734 | 12/1932 | Kuberka | 294/97 X |
| 2,584,124 | 2/1952 | Gustafson | 294/97 |
| 2,934,984 | 5/1960 | Woodman | 72/705 X |
| 2,949,144 | 8/1960 | Dredske et al. | 72/705 X |
| 3,132,890 | 5/1964 | Beaudet | 294/97 X |
| 3,385,627 | 5/1968 | Zumbo | 294/97 X |
| 3,577,881 | 5/1971 | Markovics | 72/705 X |
| 4,034,594 | 7/1977 | Morgan | 72/705 X |

FOREIGN PATENT DOCUMENTS

| | | | |
|---|---|---|---|
| 379770 | 7/1973 | U.S.S.R. | 294/97 |

*Primary Examiner*—Lowell A. Larson

*Attorney, Agent, or Firm*—Thomas N. Neiman

[57] ABSTRACT

This invention consists of a tool for use in repairing or refinishing dented material, the tool having a shaft with an interchangeable weighted head, a slidable weight or hammer, and a handle. A small hole, slightly larger than the size of the cross-sectional dimension of the interchangeable weighted head, is drilled in the dented material and the weighted head is inserted therethrough. The weighted end will rotate the head when it has passed through and cleared the hole, and the head thus forms an "inboard" anvil for applying a pulling force on the dent in the material.

1 Claim, 2 Drawing Figures

DENT PULLING TOOL

This invention pertains to metal repair and in particular to a dent pulling tool for use in the field of auto body repair. A search of the prior art revealed a large number of such tools. Examples of the standard tool in this area include the patent issued to Morgan, on July 12, 1977, No. 4,034,594, for a Variable Impact Tool. This tool uses a shaft that puts a self-tapping screw into the dented material and a large slidable weight to impact the site. The patents issued to Jones, No. 3,977,230, for an Apparatus for Repairing Indentation in a Rigid Skin, on Aug. 31, 1976, Charter, No. 3,878,709, for an Auto Body Treatment Implement, on Apr. 22, 1975, and Steinman, Jr., No. 3,635,072, for a Shaft and Cup Dent Puller, on January 18, 1972, are also examples of the previous art. All rely on the use of a self-tapping screw in their operation. In practice, this type of device often dislodges from the dented material when pull-out forces are exerted causing much delay and frustration before the operation is successfully completed.

It is the object of this invention to improve on the abovementioned devices at least by eliminating the self-tapping screw arrangement. This is accomplished by replacing the self-tapping screw with a weighted head which can be any one of various sizes. This head pivots around a center point thereof and will rotate, when the tool is twisted, so that its weighted side is down. The weighted head then presents an anvil-like flat surface, parallel to the plane of the dented material, which surface, when the sliding weight or hammer is impactingly pulled toward the user, will draw outwardly and flatten the dented metal. The use of this weighted head eliminates the potential and aforesaid problem inherent in the screw-tapping arrangement practices.

It is also the object of this invention to teach a dent pulling tool comprising a shaft; anvil means pivotally coupled at one end of said shaft; a limit stop fixed to said shaft intermediate the ends thereof; a handle stop fixed to said shaft abutting the handle of said tool; and means slidably carried by said shaft for reciprocating movement thereof, toward said handle stop and toward the end of said shaft opposite said one end, for forceable impacting of said latter means on said handle stop; wherein said anvil means comprises an elongate element having an extended groove formed therein, along at least a half length thereof, for receiving said one end of said shaft in said goove and a portion of said shaft adjacent thereto, to dispose said elongate element co-linear with said shaft.

Figure 1:
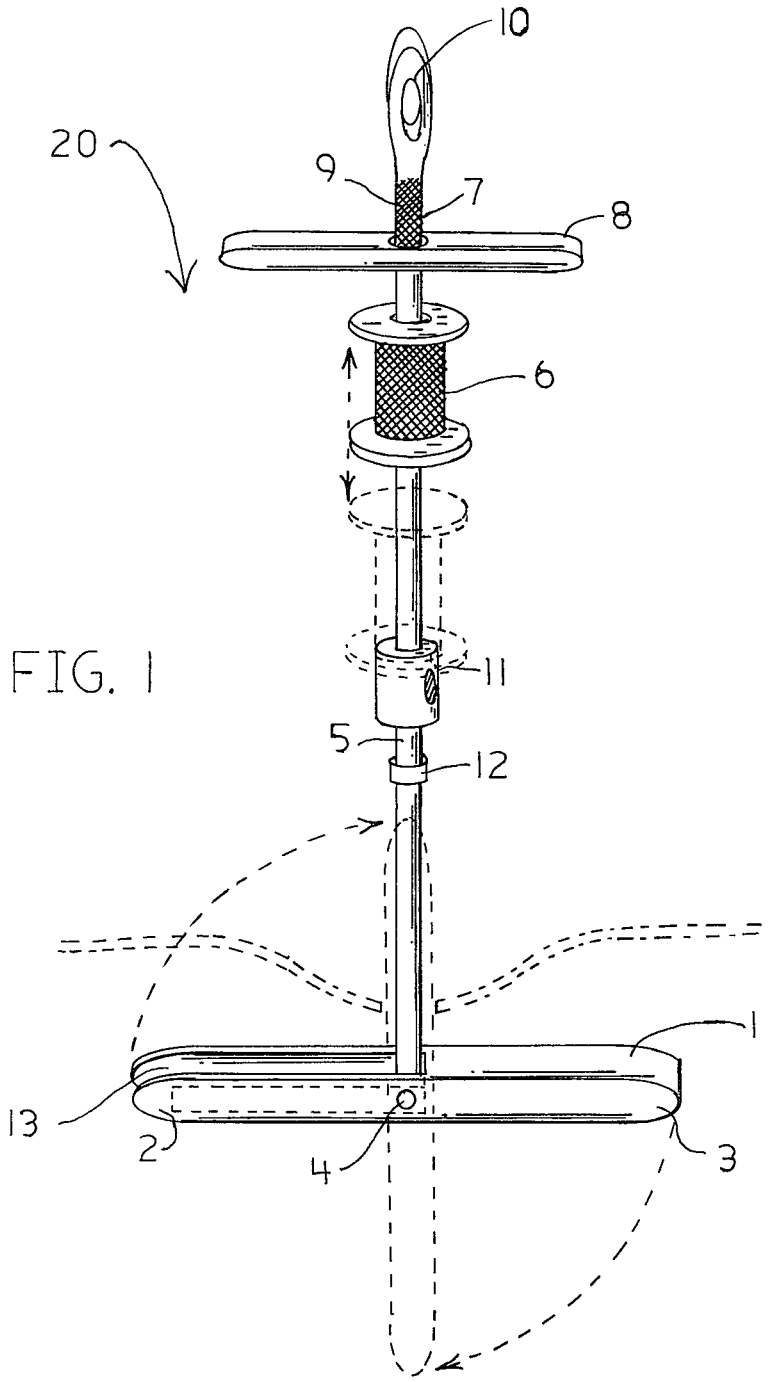
Figure 2:
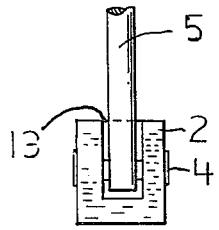

Further objects of this invention, as well as the novel features thereof, will become apparent when one studies the following description of the embodiments of the invention, taken in conjunction with the accompanying figures, in which:

FIG. 1 is a half-plan and half-elevational view of an embodiment of the novel dent pulling tool; and FIG. 2 is a fragmentary view of the lower end of the tool showing the weighted head slightly enlarged over the scale of FIG. 1, this being a front view of said lower end.

In FIG. 1, the novel dent pulling tool 20 is shown. This tool 20 consists of a weighted head 1 which has a grooved end 2 and a solid end 3. The head 1 pivots around a center swivel 4 that is attached to a shaft 5. The grooved end 2 of the head 1 receives therein the shaft 5. The head 1 and swivel 4 are attached to the shaft 5 by means of male/female connectors 12, which allows for the use of heads 1 of various sizes. A mass or hammer 6 is placed on and surrounds the shaft 5 and moves slidably up and down the shaft to a forward stop 11. A handle 7 with a handle stop 8 is attached to the end of the shaft 5 opposite the pivoting head 1. The handle 7 has a gripping surface 9 and contains a loop 10 which gives the user the ability to provide a steady pulling pressure if desired and also with which to hang the tool 20 for storage. FIG. 2 is a slightly enlarged, frontal view of the novel pivoting head 1 which shows the shaft-receiving grooved end 2. The head 1 is replaceably attached at the pivot point or swivel 4, to the shaft 5, and various sized heads can be attached. The tool 20 is used by having a small hole drilled in the center of the dent in the metal. The hole drilled is slightly larger than the size of the head 1 to be used. The requirement to use as small a hole and tool head 1 facilitates metal repair, in that the larger the hole drilled, the more difficult the finishing repair work. The head is inserted into the hole, solid end 3 first. When the entire head 1 is inserted, the tool user rotates the handle 7 slightly to give the weighted end 3 of the head 1 an initial centrifugal movement. This causes the weighted end 3 to pivot perpendicularly. The head 1 then defines a parallel stop on the opposite side of the dented metal. As shown in FIG. 1, the weighted end 3 of the head 1 has a smooth continuous surface, to allow for simpler repair of the dented metal, which extends fully across the width of the head and substantially from the shaft 5 to a terminal end of the head. Further, the head is uniformly diminished, at opposite ends 2 and 3, to facilitate both insertion and withdrawal through a metal aperture. The tool user then grasps the mass or hammer 6 with one hand and the handle 7 with the other. The hammer 6 is slidably pulled along the shaft 5 until it strikes the handle stop 8. This action causes a measurable force which withdraws or raises the dented metal to straighten it out. This action is performed as often as necessary. The use of a pulley, block and tackle, or any device designed for that purpose attached to the loop 10 is possible to provide a constant pulling force. Once the desired shape is obtained, the tool user rotates the handle 7 slowly until the weighted end 3 is pivoted to a disposition co-linear with the shaft 5, and brings the groove 13 of the head 1 to surround the shaft 5. The tool can then be withdrawn, and patching operations of the drawn-out or raised dent can begin.

Accordingly, while I have described my invention in connection with a specific embodiment thereof, it is clearly to be understood that this is done only by way of example and not as a limitation to the scope of my invention as set forth in the objects thereof and in the claims.

I claim:

1. A dent pulling tool, comprising:

a shaft;

anvil means pivotally coupled at one end of said shaft;

a tool handle formed at one end of said shaft which is opposite said one end;

a limit stop fixed to said shaft abutting the handle of said tool;

means slidably carried by said shaft for reciprocating movement thereof, toward said handle stop and toward the end of said shaft opposite said one end, for forceable impacting of said latter means on said handle stop; wherein said anvil means comprises an elongate element having an extended groove formed therein, along at least a half length thereof, for receiving said one end of said shaft in said groove and a portion of said shaft adjacent thereto, to dispose said elongate element co-linear with said shaft;

said elongate element has a first half portion thereof which is of a given weight, and a second half portion thereof which is of a weight greater than said given weight;

said second half portion of said element has greater weight to facilitate rotation of said element when inserted through constricted apertures without the use of external devices;

said element has a smooth, continuous surface which extends fully across the width thereof and covers said second half portion of said element;

said element further has uniformly-diminished cross-sections at opposite ends thereof to facilitate insertion and withdrawal of said element through constricted apertures;

said groove is formed in said first half portion of said elongate element;

said slidably-carried impacting means comprises an annular hammer;

said handle contains pulling means; and said pulling means comprises a loop attached to said handle.

* * * * *